United States Patent [19]

Moriya et al.

[11] Patent Number: 4,761,771

[45] Date of Patent: Aug. 2, 1988

[54] ELECTRONIC TIMEKEEPING APPARATUS WITH TEMPERATURE COMPENSATION AND METHOD FOR COMPENSATING SAME

[75] Inventors: Tatsuo Moriya; Hitomi Aizawa; Kuniharu Natori; Kazumi Kamoi; Hiroshi Yabe, all of Suwa, Japan

[73] Assignee: Seiko Epson Corporation, Tokyo, Japan

[21] Appl. No.: 46,063

[22] Filed: May 4, 1987

Related U.S. Application Data

[63] Continuation-in-part of Ser. No. 763,118, Aug. 7, 1985, abandoned.

[30] Foreign Application Priority Data

Aug. 9, 1984 [JP] Japan ..... 59-167048
Aug. 13, 1984 [JP] Japan ..... 59-168992

[51] Int. Cl.[4] ..... G04B 17/12
[52] U.S. Cl. ..... 368/202
[58] Field of Search ..... 368/200–202, 368/155–157, 159; 331/176

[56] References Cited

U.S. PATENT DOCUMENTS

| | | | |
|---|---|---|---|
| 3,568,093 | 3/1971 | Ishida et al. | 331/116 |
| 3,719,838 | 3/1973 | Peduto et al. | 310/81 |
| 4,015,208 | 3/1977 | Hammer et al. | 331/176 |
| 4,300,224 | 11/1981 | Nakazaki et al. | 368/201 |
| 4,321,698 | 3/1982 | Gomi et al. | 368/202 |
| 4,443,116 | 4/1984 | Yoshida et al. | 368/602 |
| 4,453,834 | 6/1984 | Suzuki et al. | 368/201 |
| 4,473,303 | 9/1984 | Suzuki | 368/201 |
| 4,475,180 | 10/1984 | Sekiya et al. | 365/228 |
| 4,502,790 | 3/1985 | Yokoyama | 368/200 |
| 4,513,259 | 4/1985 | Frerking | 331/176 |
| 4,537,515 | 8/1985 | Dinger et al. | 368/202 |

FOREIGN PATENT DOCUMENTS

| | | |
|---|---|---|
| 2548848 | 2/1980 | France . |
| 2431794 | 6/1983 | France . |
| 56-19482 | 2/1981 | Japan . |
| 58-223778 | 12/1983 | Japan . |
| 625670 | 10/1981 | Switzerland . |
| 626500 | 10/1981 | Switzerland . |
| 2025721 | 1/1980 | United Kingdom . |
| 2091511 | 7/1982 | United Kingdom . |

*Primary Examiner*—Vit W. Miska
*Attorney, Agent, or Firm*—Blum Kaplan

[57] ABSTRACT

An electronic timekeeping apparatus includes a temperature value generating circuit for generating a temperature value, a temperature value converting circuit including a slope adjusting circuit which provides a slope corrected output in accordance with a frequency versus temperature characteristic of the apparatus in response to the temperature value, a pace compensation data circuit for producing pace compensation data corresponding to the slope corrected output, and a pace compensating circuit for compensating pace of the apparatus in accordance with the pace compensation data. An offset adjustment circuit may operate on said temperature value or said slope corrected output. A method for compensating pace of an electronic timekeeping apparatus includes the steps of generating a temperature value corresponding to temperature of the apparatus, correcting the temperature value in accordance with slope of a frequency versus temperature characteristic of the apparatus to produce a slope corrected value, producing pace compensation data in response to the slope corrected value, and adjusting the pace in accordance with the pace compensation data.

68 Claims, 8 Drawing Sheets

ELECTRONIC TIMEKEEPING APPARATUS WITH TEMPERATURE COMPENSATION AND METHOD FOR COMPENSATING SAME

CROSS REFERENCE TO RELATED APPLICATION

This is a continuation-in-part of application Ser. No. 763,118 filed Aug. 7, 1985, now abandoned.

BACKGROUND OF THE INVENTION

The present invention is generally directed to an electronic watch or clock and more particularly to a method and apparatus for performing temperature compensation of the temperature characteristics of a quartz crystal oscillator in which compensating data is stored in a read only memory ("ROM").

U.S. Pat. No. 3,719,838 uses data written directly into a programmable read only memory ("PROM") before compensating the temperature-frequency characteristic of a quartz crystal oscillator. Data corresponding to the temperature values is written directly into the PROM.

Japanese Patent Laid Open Publication No. 56-19482 discloses the use of temperature compensation data previously written into a Mask ROM wherein the address of the data is designated by the output conditions of a divider circuit. A given address is designated when the number of output pulses of a temperature sensing oscillator circuit reaches the number determined by a dividing ratio setting means.

Japanese Patent Laid Open Publication No. 58-223778 discloses a compensating circuit wherein the output of an A/D converter circuit is adjusted to produce a temperature value and wherein the temperature compensating data has previously been written into a Mask ROM. The data is called by the output of the temperature compensating circuit.

The temperature compensation method of U.S. Pat. No. 3,719,838 permits directly writing temperature compensation data, which corresponds to the temperature value, into a PROM, for compensating for the temperature characteristic of a quartz crystal oscillator. Thus, even though the secondary temperature coefficient and peak temperature of the quartz crystal oscillator may be varied, it is possible to adjust these parameters to correspond to the temperature value of each timepiece. This is an ideal temperature compensating method. However, the size of a nonvolatile memory circuit utilizing MNOS or FAMOS transistors in a PROM is three or four times as large as the size of MOS transistors used in a Mask ROM. For an electronic timepiece having an accuracy of approximately 5 seconds per year, a large memory capacity in the ROM is required. The size of the integrated circuit memory chip becomes extremely large and the circuit cannot be used in a wrist watch where space is limited.

In the other methods outlined above, the size of the chip is not an issue since a Mask ROM is used. However, while both methods provide a means for adjusting an offset temperature value, these methods do not provide a means for adjusting for the extent of the change in temperature; that is there is no adjustment made for slope. Thus, while it is possible to adjust for variation in the peak temperature of the quartz crystal oscillator circuit, it is not possible to adjust for variations in the secondary temperature coefficient. Therefore, the larger the departure from the peak temperature, the greater the error in pace. In order to obtain a high accuracy such as 5 seconds per year, special quartz crystal vibrators having sections with different secondary coefficients of temperature should be used. This results in very high manufacturing costs.

SUMMARY OF THE INVENTION

The present invention is generally directed to an electronic timekeeping apparatus having temperature compensation wherein adjustment of the pace of the apparatus to correct for variations in the peak temperature and in the secondary temperature coefficient of the quartz crystal oscillator can be performed.

The electronic timekeeping apparatus according to the present invention comprises a temperature value generating means for generating a temperature value. A temperature value converting means, including a slope adjusting means provides a slope corrected output, in accordance with the frequency versus temperature characteristics of the apparatus, in response to the temperature value. A pace compensation data means produces pace compensation data corresponding to the slope corrected output. A pace compensating means compensates the pace of the apparatus in accordance with the pace compensation data. An offset adjusting means may operate on said temperature value or said slope corrected output.

In accordance with the present invention the electronic timekeeping apparatus includes an oscillator and a divider circuit. The divider circuit divides the output of the oscillator circuit and both the oscillator and the divider circuit define the pace of the apparatus. A pace compensation data means produces pace compensation data for compensating the pace of the apparatus. A first compensation means responsive to M least significant data bits of the pace compensation data compensates pace by controlling the oscillator. A second compensation means responsive to data bits of the pace compensation data other than the least significant bits compensates pace by controlling the divider circuit.

The invention is also directed to a method for compensating pace of an electronic timekeeping apparatus comprising the steps of generating a temperature value corresponding to temperature of the apparatus, correcting the temperature value in accordance with the slope of a frequency versus temperature characteristic of the apparatus to produce a slope corrected value, producing pace compensation data in response to the slope corrected value and adjusting the pace in accordance with the pace compensation data. Further, in accordance with the invention, a compensation period is defined and corrections for each of temperature, factory peak pace and service peak pace are performed during the compensation period.

Accordingly, it is an object of the present invention to provide an improved electronic timekeeping apparatus which compensates for variations in the peak temperature and secondary temperature coefficient of a quartz crystal oscillator without using a PROM which requires an integrated circuit of large size.

Another object of the present invention is to provide an electronic timepiece having high resolution pace adjustment.

A further object of the present invention is to provide an electronic timepiece of low price, small size and high precision.

A further object of the present invention is to provide a method for compensating the pace of an electronic timekeeping apparatus which provides high precision and can be performed rapidly and accurately by a general watchmaker.

Still other objects and advantages of the invention will in part be obvious and will in part be apparent from the specification.

The invention accordingly comprises the several steps and the relation of one or more of such steps with respect to each of the others, and the apparatus embodying features of construction, combinations of elements and arrangement of parts which are adapted to effect such steps, all as exemplified in the following detailed disclosure, and the scope of the invention will be indicated in the claims.

BRIEF DESCRIPTION OF THE DRAWINGS

For a fuller understanding of the invention, reference is had to the following description taken in connection with the accompanying drawings, in which.

DETAILED DESCRIPTION OF THE PREFERRED EMBODIMENT

The present invention is generally directed to a timekeeping apparatus which is compensated for variations in pace due to changes in temperature and to a method of compensating the apparatus. The present invention will be described with reference to a timepiece such as a wrist watch, but it will be understood that the present invention may also be applied to a clock or other timekeeping apparatus.

Figure 1:
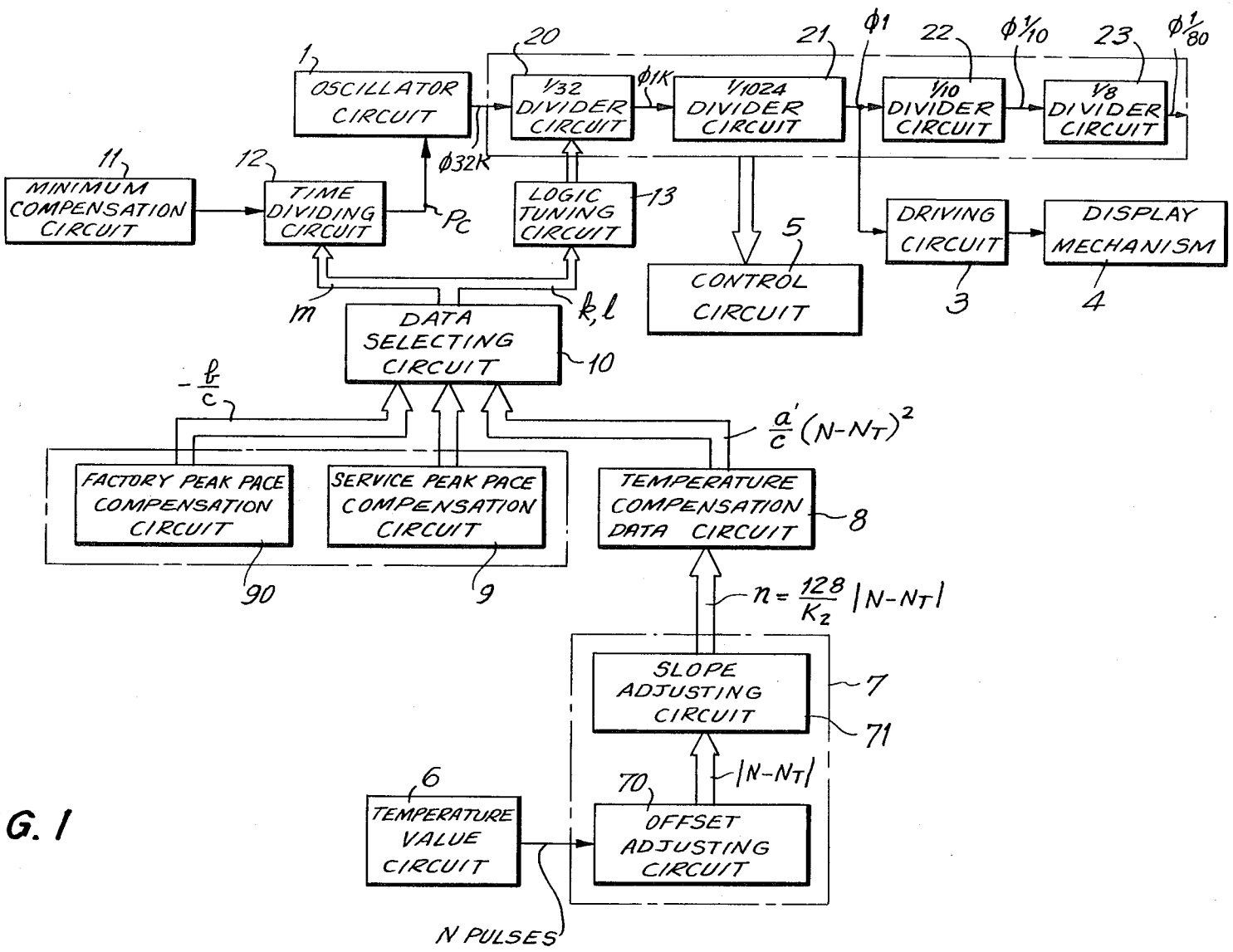
FIG. 1 is a block diagram of an electronic timepiece which is temperature compensated in accordance with a preferred embodiment of the invention.

Reference is made to FIG. 1 which is a block diagram of an electronic timepiece which is temperature compensated in accordance with the invention. A quartz crystal oscillator circuit 1 having a second order curvature temperature versus frequency characteristic provides an output $\phi$32K to a divider circuit 2. Divider circuit 2 includes a 1/32 divider circuit 20, a 1/1024 divider circuit 21, a 1/10 divider circuit 22 and a $\frac{1}{8}$ divider circuit 23. Divider circuit 20 divides signal $\phi$ 32K of 32,768 Hz from oscillator circuit 1 into signal $\phi$1K of 1,024 Hz. The 1/1024 divider circuit 21 divides signal $\phi$1K into signal $\phi$1 having a frequency of 1 Hz. Signal $\phi$1 is then divided by 1/10 divider circuit 22 into a signal $\phi$1/10 having a frequency of 1/10 Hz. The $\frac{1}{8}$ divider circuit 23 divides signal $\phi$1/10 into a signal $\phi$1/80 having a frequency of 1/80 Hz.

A driving circuit 3 supplied with signal $\phi$1 produces an alternating signal for driving a stepping motor included in a display mechanism 4. Display mechanism 4 may be any of several types of display devices such as a display device which also includes a gear train, a second hand, a minute hand and an hour hand. Both driving circuit 3 and display mechanism 4 may be of a type well known in the art.

Divider circuit 2 supplies signals $\phi$1, $\phi$1/2, $\phi$256, and $\phi$32K, as well as various other outputs of divider circuits 22 and 23, to control circuit 5. Using these as inputs, control circuit 5 generates control output signals $S_0$ through $S_{10}$ as more fully discussed below.

A temperature value circuit 6 (FIG. 1) detects the temperature in the timepiece and delivers a pulse train having N pulses as temperature data. A temperature converting circuit 7 receives the N pulses. Temperature converting circuit 7 comprises an offset adjusting circuit 70 which converts the N pulses delivered from temperature value circuit 6 to the form of $|N\text{-}N_T|$ and a slope adjusting circuit 71 for multiplying $|N\text{-}N_T|$ by $128/K_2$, where $K_2$ is a slope adjusting value stored in a PROM as noted below.

A temperature compensation data circuit 8 provides nine bits of temperature characteristic compensation data $D_n=[a_o \cdot n^2/c]$ which corresponds to a temperature converting value $N=[128 \cdot |N-N_T|/K_2]$ supplied by temperature converting circuit 7.

A peak pace compensation circuit 9 memorizes ten bits of compensating data $[-b/c]$ for setting a pace of b seconds per day (see equation 1 below) as the compensation value (at a peak temperature) equal to zero. Peak pace compensation circuit 9 includes a factory peak pace compensation circuit 90 utilizing a PROM and a service peak pace compensation circuit 91 for service later in the life of the timepiece. Circuit 91 contains a circuit block having a wiring pattern that can be cut for purposes of programming.

A data selecting circuit 10 selects data designated by a control signal from control circuit 5. One of the temperature characteristic compensation data from temperature compensation data circuit 8, factory peak pace compensation data from factory peak pace compensation circuit 90 and service peak pace compensation data from service peak pace compensation circuit 91 is selected by data selecting circuit 10. The selected data is utilized as explained below.

A minimum compensation circuit 11 defines a minimum compensation value of C seconds per day of pace. A time dividing circuit 12 forms a time dividing signal $P_C$ for compensating the frequency of oscillation of quartz crystal oscillator circuit 1 by using the five least significant bits of the ten bits of data delivered from data selecting circuit 10. The remaining or five most significant bits of data delivered from data selecting circuit 10 are supplied to a logic tuning circuit 13 which adjusts the pace by setting 1/32 divider circuit 20 to an advance or delay condition in accordance with the value of these most significant bits.

Reference is now made with respect to the manner in which temperature characteristic compensating data is generated and the relationship between the temperature value circuit 6, temperature converting circuit 7 and temperature compensation data circuit 8.

When quartz crystal oscillator 1 is not compensated, its pace y with respect to temperature $\phi$ may be approximated by the following equation:

$$y=-a\cdot(\theta-\theta_T)^2+b(\text{sec/day}) \quad (1)$$

wherein a is a second order curvature temperature characteristic coefficient, $\theta_T$ is peak temperature and b is pace at peak temperature.

The value of temperature, represented by N pulses, provided by temperature value circuit 6 is approximated by the following equation:

$$N=A\theta+B \quad (2)$$

wherein A is a constant representing slope and B is a constant representing the temperature value at 0° C.

Rearrangement of equation (2) yields:

$$\theta=(N-B)/A \quad (2)'$$

Assuming that the value of temperature N at the peak temperature $\theta_T$ is $N_T$, then:

$$\theta_T=(N_T-B)/A \quad (2)''$$

By substituting equations (2)' and (2)'' into equation (1), the following relationship for the pace y of the quartz crystal oscillator 1 with respect to the value of temperature N when pace is uncompensated is given by the equation:

$$y=-a'\cdot(N-N_T)^2+b \text{ (sec/day)} \quad (3)$$

wherein a' is equal to $a/A^2$.

In order to obtain a flat temperature characteristic for quartz crystal oscillator circuit 1, that is to compensate the frequency so that it does not change with temperature, compensation should be equal to $a'\cdot(-N_T)^2$ seconds per day in the direction of advance. In order to compensate by this amount, when the minimum compensation amount is C sec/day, the number of steps Y required for compensation is obtained by the following equation:

$$Y=[a'\cdot(N-N_T)^2/c] \quad (4)$$

wherein the symbol [ ]represents setting the value equal to the nearest integer.

If a temperature converting value n is received, the temperature compensation data circuit 8 provides temperature compensating data $D_n$ represented by the following equation:

$$D_n=[a_o'\cdot n^2/c] \quad (5)$$

In order to generate data $D_n$ equivalent to the number of steps Y which must be compensated by temperature compensation data circuit 8, the temperature converting value n given by the following equation is produced by temperature converting circuit 7.

$$n=[(a'/a_o')^{\frac{1}{2}}\cdot|N-N_T|] \quad (6)$$

Since a' is equal to $a/A^2$, the value of a is in the range of 0.0025 to 0.0035 and the value of A is in the range between 10 and 20. Thus, the value of a' is in the range between $6.25\times10^{-6}$ and $3.5\times10^{-5}$. When $a'_0$ is the maximum value of $3.5\times10^{-5}$, the value of $(a'/a_o')^{\frac{1}{2}}$ in equation (6) is in the range between 0.4226 and 1. In the circuit configuration shown, it is difficult to multiply a number in this latter range by $|N-N_T|$. However if $(a'/a_o')^{\frac{1}{2}}$ is set equal to $128/K_2$, the value $K_2$ is in the range between 128 and 303 (as rounded off to the nearest integer). When temperature value N is received from temperature value circuit 6, temperature converting circuit 7 computes a value of:

$$n=[128|N-N_T|/K_2].$$

This result is provided as an input to temperature compensation data circuit 8. Thus, data $D_n$, equivalent to the number of steps Y to be compensated as obtained from equation (4) is provided by temperature compensation data circuit 8.

Figure 2:
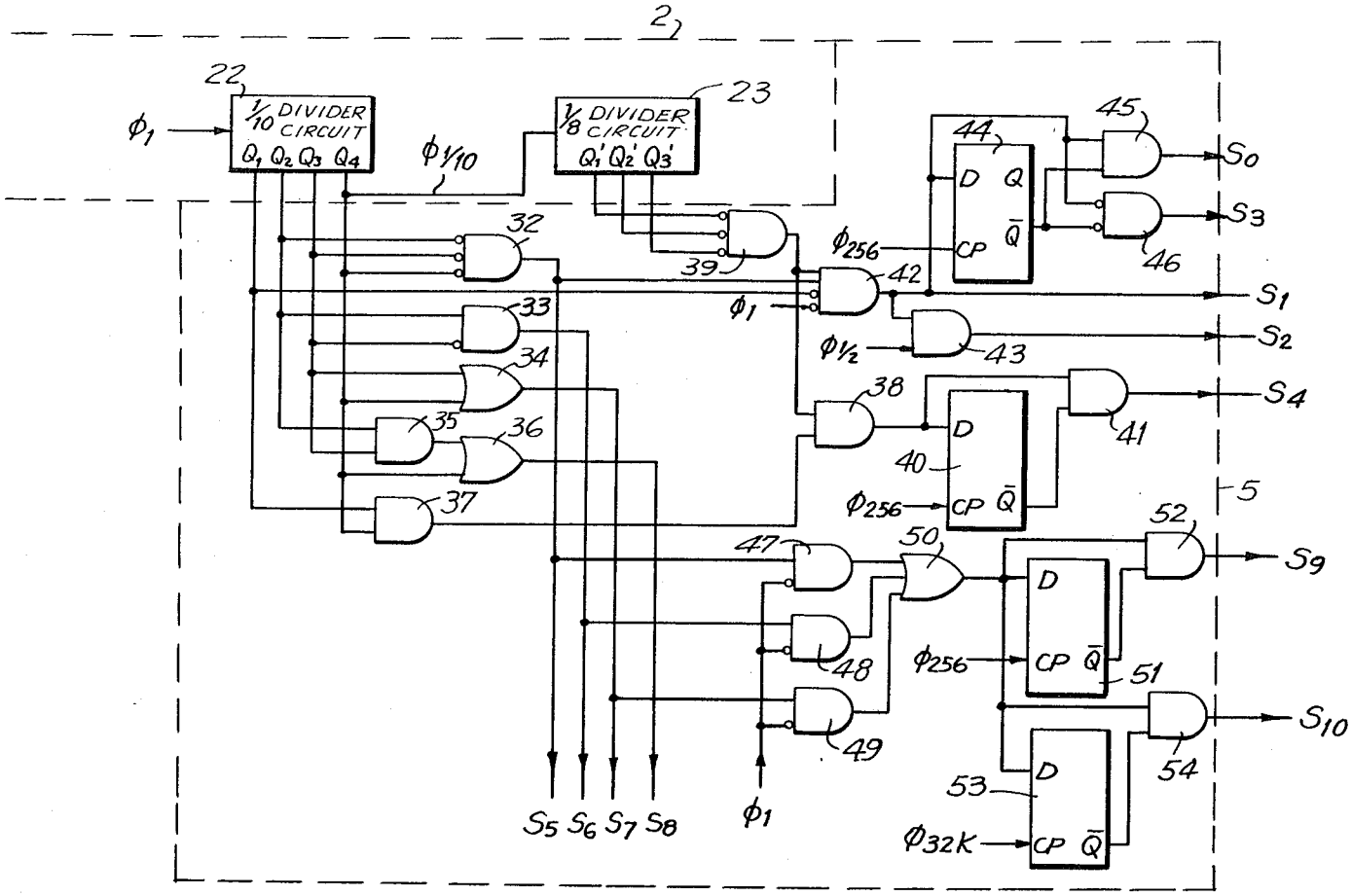
FIG. 2 is a block diagram of the control circuit of FIG. 1.
Figure 3:
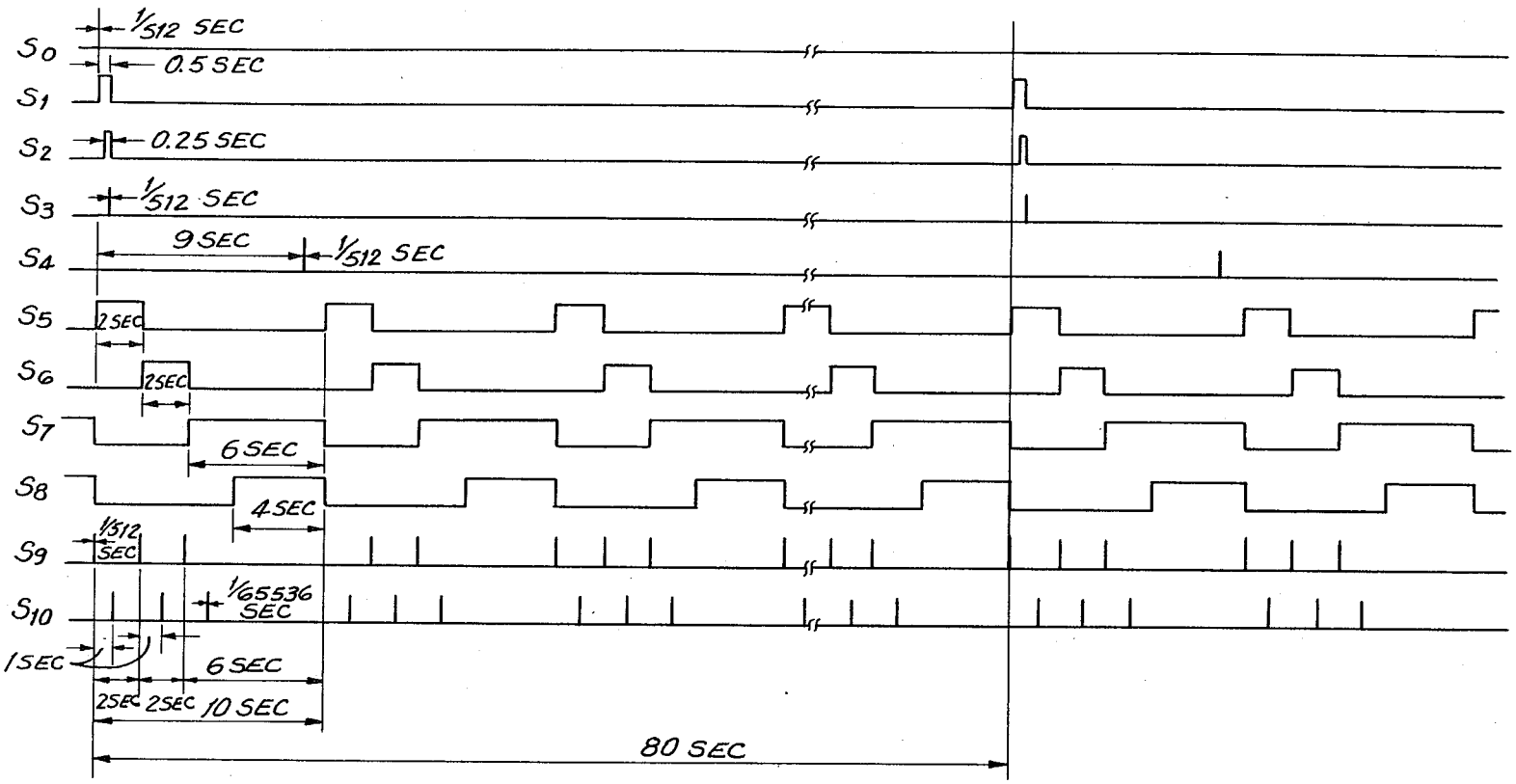
FIG. 3 is a timing diagram of output signals of the control circuit of FIG. 1.

Referring to FIG. 2, a specific embodiment for control circuit 5 is depicted, the circuit being adapted to generate control signals $S_1$ to $S_{10}$ as shown in FIG. 3. Control circuit 5 generates said control signals from various signals received from divider circuit 2, 1/10 divider circuit 22 and $\frac{1}{8}$ divider circuit 23 thereof, being shown in FIG. 2. The $Q_1$, $Q_2$, $Q_3$ and $Q_4$ outputs of 1/10 divider circuit 22 are supplied to a series of gates to form control signals $S_5$, $S_6$, $S_7$ and $S_8$. Outputs $Q_2$, $Q_3$ and $Q_4$ of 1/10 divider circuit 22 are supplied to the three inverting inputs of AND gate 32 which produces control signal $S_5$. Outputs $Q_2$ and $Q_3$ are supplied to a noninverting and inverting input, respectively, of AND gate 33, which produces control signal $S_6$. Outputs $Q_3$ and $Q_4$ are supplied to the inputs of OR gate 34 which produces control signal $S_7$. Outputs $Q_2$ and $Q_3$ are supplied to the inputs of AND gate 35 which produces an output signal supplied to one of the inputs of OR gate 36. Output $Q_4$ of 1/10 divider circuit 22 is supplied to the other input of OR gate 36 which produces control signal $S_8$.

The $Q_1$ and $Q_4$ outputs of 1/10 divider circuit 22 are supplied to the inputs of AND gate 37. The output of AND gate 37 is supplied to a first input of AND gate 38.

The $Q_1'$, $Q_2'$ and $Q_3'$ outputs of $\frac{1}{8}$ divider circuit 23 are supplied to the three inverting inputs of AND gate 39. The output of AND gate 39 is supplied to the other input of AND gate 38. The output of AND gate 38 is provided to the data input of flip-flop 40 and to one input of AND gate 41. The other input of AND gate 41 is supplied with the $\overline{Q}$ output of flip-flop 40. Flip-flop 40 is clocked by the $\phi256$ signal from divider circuit 2, so that AND gate 41 produces control signal $S_4$.

The output of AND gate 39 is also supplied to one of the noninverting inputs of AND gate 42. A second noninverting input of AND gate 42 is supplied with control signal $S_5$ produced by AND gate 32. An inverting input of AND gate 42 is supplied with the $Q_1$ output of 1/10 divider circuit 22. A second inverting input of AND gate 42 is supplied with the $\phi1$ signal from divider circuit 2. AND gate 42 thus produces control signal $S_1$.

Control signal $S_1$ is also supplied to one input of AND gate 43. The other input of AND gate 43 is supplied with the $\phi\frac{1}{2}$ signal from divider circuit 2. AND gate 43 thus produces control signal $S_2$.

Control signal $S_1$ is supplied to the data input of flip-flop 44, to one input of AND gate 45 and to one of two inverting inputs of AND gate 46. The $\overline{Q}$ output of flip-flop 44 is supplied to the other input of AND gate 45 and to the second inverting input of AND gate 46. The clock pulse input of flip-flop 44 is supplied with the $\phi 256$ signal causing AND gate 45 to produce control signal $S_0$ and AND gate 46 to produce control signal $S_3$.

The $\phi 1$ signal from divider circuit 2 is supplied to the inverting inputs of AND gates 47, 48 and 49. The noninverting inputs of AND gates 47, 48 and 49 are respectively supplied with control signals $S_5$, and $S_6$ and $S_7$. The outputs of AND gates 47, 48 and 49 are supplied to the inputs of OR gate 50. The output of OR gate 50 is supplied to the data input of flip-flop 51, one input of AND gate 52, the data input of flip-flop 53 and one input of AND gate 54. The $\overline{Q}$ output of flip-flop 51 is supplied to the other input of AND gate 52 while the $\overline{Q}$ output of flip-flop 53 is supplied to the second input of AND gate 54. The $\phi 256$ signal from divider circuit 2 is supplied to the clock pulse input of flip-flop 51 and AND gate 52, thus producing signal $S^9$. The $\phi 32K$ signal from divider circuit 2 is supplied to the clock pulse input of flip-flop 53; AND gate 54 produces output control signal $S_{10}$.

Control signals $S_1$ through $S_{10}$, shown in FIG. 3, are used to control the circuits described below.

Figure 4:
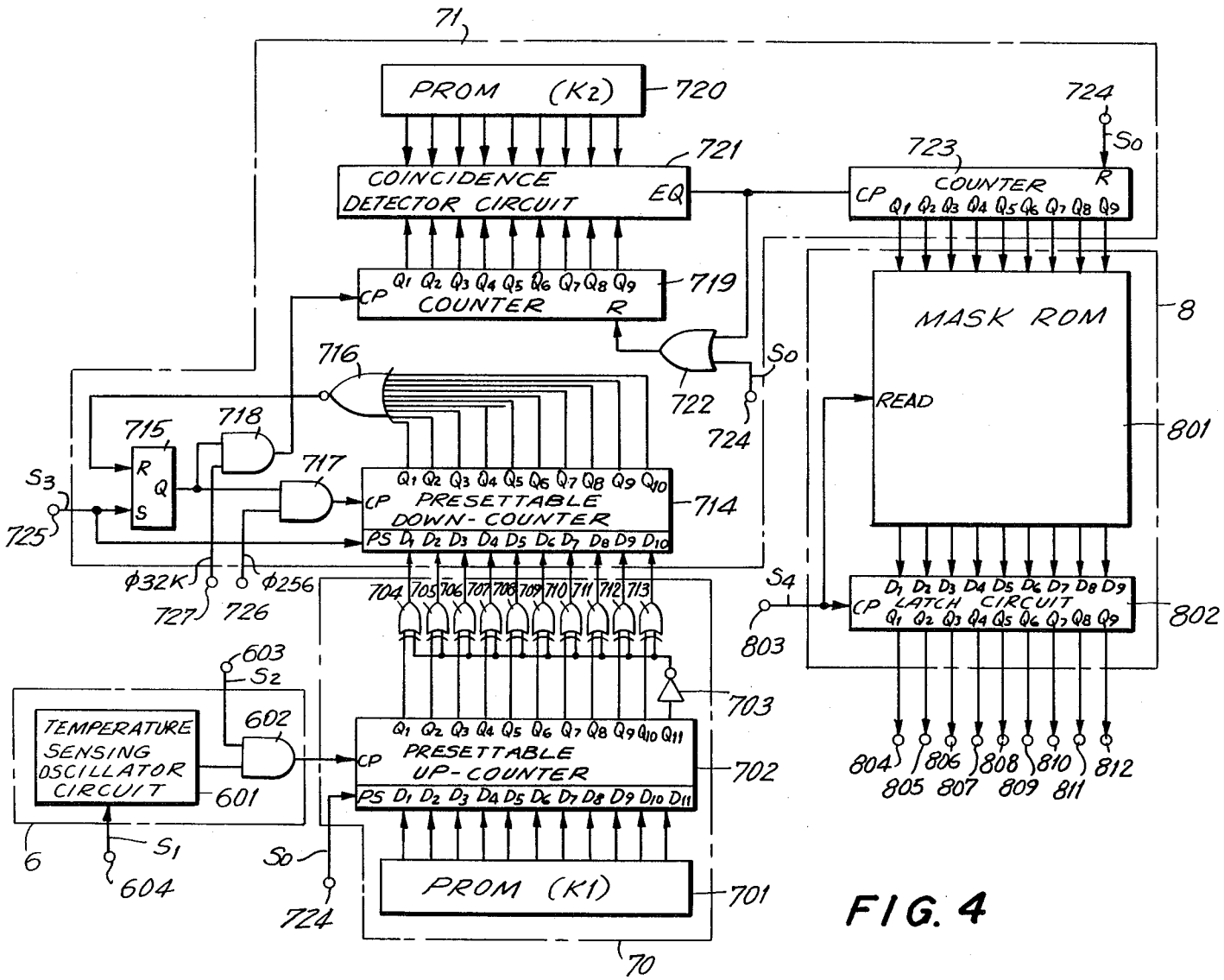
FIG. 4 is a schematic diagram illustrating the temperature value circuit, temperature converting circuit and temperature compensation data circuit of FIG. 1.

Reference is now made to FIG. 4 to describe temperature value circuit 6, temperature converting circuit 7, temperature compensation data circuit 8 and the interrelationship therebetween.

Temperature value circuit 6 includes a temperature sensing oscillator circuit 601 and AND gate 602. Temperature sensing oscillator circuit 601 operates only when control signal $S_1$, at a high logic level, is provided to input terminal 604. The oscillation frequency of oscillator circuit 601 with respect to temperature $\phi$ is approximated by the following equation:

$$f = A'\theta + B' \tag{7}$$

where A' and B' are constants. Output pulses of oscillator circuit 601 are passed through AND gate 602 only when control signal $S_2$, at a logic high level, is provided through input terminal 603 to AND gate 602. Equation (2) set forth above may be used to calculate the number of pulses N which pass through AND gate 602 at that time. In view of possible variations in the value of A' of equation (7), the width of control signal $S_2$ is set so that the value of A in equation (2) is more than 10. In the embodiment described herein, the value of A' is more than 40, and the width of control signal $S_2$ is therefore 0.25 second.

An offset adjusting circuit 70, included in temperature converting circuit 7, comprises a PROM 701 for memorizing an 11 bit offset adjusting value $K_1$, a presettable up-counter 702, an inverter 703 and exclusive OR gates 704 to 713.

A value of $K_1$ of $[2^{10}-N_T]$is written into PROM 701. This value is provided as an input to presettable up-counter 702 when control signal $S_0$, applied to terminal 724, is at a high logic level. Up-counter 702 then counts the N pulses provided by AND gate 602. The value represented by output terminals $Q_1$ to $Q_{11}$ of up-counter 702 after the N pulses have been counted is then $[2^{10}-N_T+N]$. The value of the 10 bits of data represented by the outputs of exclusive OR gates 704 to 713 is the logical inverted value of the output presented by outputs $Q_1$ to $Q_{10}$, when the output of terminal $Q_{11}$ of up-counter 702 is at a low logic level. When the output of $Q_{11}$ is at logic high, the value of the ten bits of data at the outputs of OR gates 704 to 713 is the value represented by the outputs $Q_1$ to $Q_{10}$. Therefore, the value represented by the outputs of exclusive OR gates 704 to 714 is $[|2^{10}-N_T+N-2^{10}|]=[|N-N_T|]$.

Slope adjusting circuit 71, in temperature converting circuit 7, includes a presettable down-counter 714, an R-S flip-flop circuit 715 in which a set signal is preferred, a NOR gate 716, AND gates 717 and 718, an up-counter 719, a PROM 720 for memorizing a 9 bit slope adjusting value $K_2$, a coincidence detector 721, an OR gate 722 and an up-counter 723.

Up-counters 719 and 723 are reset to zero when control signal $S_0$, provided to terminal 724 goes to a high logic level. Further, the value $[|N-N_T|]$ represented by the outputs of exclusive OR gates 704 through 713 is supplied to presettable down-counter 714 when control signal $S_3$, supplied to terminal 725, is at a high logic level. Output Q of R-S flip-flop 715 is high from the moment when control signal $S_3$ becomes high, until the $\phi 256$ signal of 256 Hz from divider circuit 2, applied to input terminal 726 has supplied $[|N-N_T|]$ pulses through AND gate 717 to terminal CP of down-counter 714, and until outputs $Q_1$ to $Q_{10}$ go to logic level zero causing the output of NOR gate 716 applied to the R input of R-S flip-flop 715 to go to a high logic level. During this period AND gate 718 passes the $\phi 32K$ signal of 32,768 Hz from divider circuit 2 to terminal CP of counter 719. Therefore, the number of pulses passing through AND gate 718 is 32,768/256 multiplied by the number of pulses passing through AND gate 717; that is $[128\cdot|N-N_T|]$ pulses.

After being reset by control signal $S_0$, which is supplied to terminal 724 and passes through OR gate 722 to reset terminal R, counter 719 starts counting the pulses which pass through AND gate 718. When the count in counter 719 coincides with the value of $K_2$ written into PROM 720, coincidence detector circuit 721 provides a logic high signal at terminal EQ. Further, counter 719 is again reset by way of OR gate 722 so that the number of times that a high logic level signal appears at terminal EQ of coincidence detector 721 is $[128\cdot|N-N_T|/K_2]$. Therefore, the temperature converting value n represented by outputs $Q_1$ to $Q_9$ of counter 723 is also $[128\cdot|N-N_T|/K_2]$.

Temperature compensation data circuit 8 comprises a latch circuit 802 and a Mask ROM 801 having a 9 bit×300 word storage arrangement addressed by outputs $Q_1$ to $Q_9$ of counter 723. Data $D_n$ represented by equation (5) is written into the address n of Mask ROM 801 and the data is read out when control signal $S_4$, applied to terminal 803 is at logic high level. Latch circuit 802 which also receives control signal $S_4$ at its CP input holds the output data $D_n$ of Mask ROM 801 for a period of 80 seconds until the following data is processed.

The following equations show that the data $D_n$ provided by temperature compensation data circuit 8 is equal to the number of compensating steps Y of equation (4).

$$\begin{aligned} D_n &= a_o' \cdot n^2/c \\ &= a_o' \cdot (128 \cdot |N - N_T|/K_2)^2/c \\ &= a_o' \cdot ((a'/a_o')^{\frac{1}{2}} \cdot |N - N_T|)^2/c \\ D_n &= a' \cdot (|N - N_T|)^2/c \end{aligned}$$

In the embodiment of the invention illustrated herein, pace compensation is performed repetitively at a 10 second period. Compensation for temperature characteristic, factory peak pace and after service peak pace, respectively, are performed independently at different times during the period. According to the embodiment described herein compensation is performed by logic tuning to an accuracy of $1/32{,}768 \times 86{,}400/10 = 0.2637$ sec/day and is further performed by connecting and disconnecting a reactive element in quartz crystal oscillator circuit 1, as described below, to an accuracy of approximately $0.2637/32 = 0.0082$ sec/day.

Figure 5:
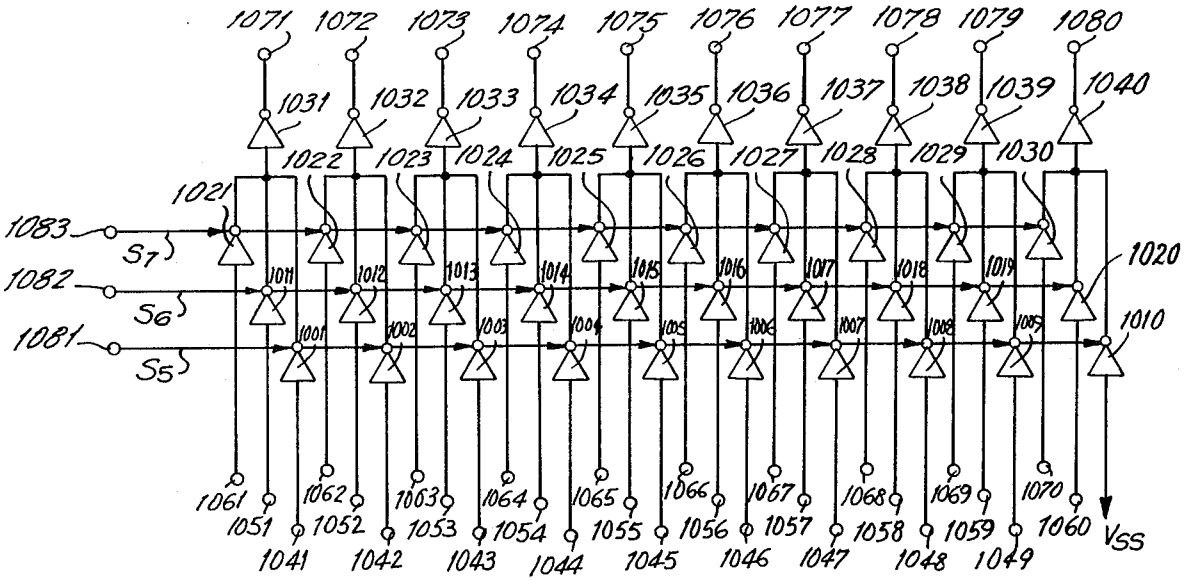
FIG. 5 is a schematic diagram of the data selecting circuit of FIG. 1.

FIG. 5 is an example of an actual arrangement for data selecting circuit 10 of FIG. 1. The 9 bit temperature characteristic compensating data from terminals 804 through 812 of temperature compensation data circuit 8 are supplied to terminals 1041 to 1049. Ten bits of data from factory peak pace compensation circuit 90 are supplied to terminals 1061 to 1070. Clocked inverters 1001 to 1010 are held on for a period of 2 seconds when control signal $S_5$, provided to terminal 1081, is at a high logic level and deliver temperature characteristic compensation data via inverters 1031 to 1040 to terminals 1071 to 1080. Clocked inverters 1011 to 1020 are held on for a period of 2 seconds when a control signal $S_6$, supplied to terminal 1082, is at a logic high level and deliver factory peak pace compensation data via inverters 1031 to 1040 to terminals 1071 to 1080. Clocked inverters 1021 to 1030 are held on during the remaining 6 seconds of the 10 second data compensation period mentioned above, when control signal $S_7$ provided to terminal 1083 is at a high logic level, and deliver service peak pace compensation data via inverters 1031 to 1040 to terminals 1071 through 1080.

Figure 6:
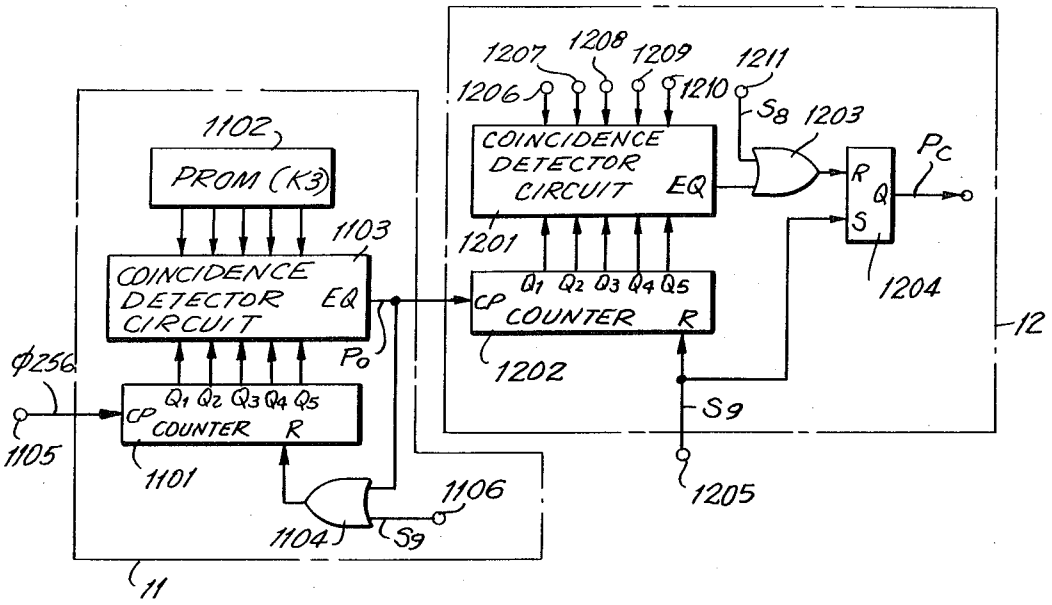
FIG. 6 is a schematic diagram of the minimum compensation circuit and time dividing circuit of FIG. 1.

Minimum compensation circuit 11 of FIG. 1 depicted in FIG. 6, comprises an up-counter 1101, a PROM 1102 for memorizing five bit minimum compensation determining value $K_3$, a coincidence detector circuit 1103 and an OR gate 1104. When counter 1101 counts the $\phi 256$ signal of 256 Hz from divider circuit 2 provided to terminal 1105 $K_3$ times, terminal EQ of coincidence detector circuit 1103 goes to a high logic level and counter 1101 is reset through OR gate 1104. Further, after control signal $S_9$, provided to terminal 1106, goes to a high logic level, counter 1101 is reset. Thus, one period of output signal $P_0$ at terminal EQ of coincidence detector circuit 1103 is $K_3/256$ seconds.

Also illustrated in FIG. 6 is time dividing circuit 12 of FIG. 1 which comprises a coincidence detector circuit 1201, an up-counter 1202, an OR gate 1203 and an R-S flip-flop circuit 1204 in which the reset signal is preferred. Terminals 1206 to 1210 are connected to the five least significant bits (terminals 1071 to 1075 of FIG. 5) of the ten bit data selected by data selecting circuit 10. Assuming the value represented by the five least significant bits of data is m, when counter 1202 counts m pulses of signal $P_o$ after being reset by control signal $S_9$ supplied to terminal 1205, terminal EQ of coincidence detector 1201 goes to a high logic level. A time dividing signal $P_C$ is provided at output Q of R-S flip-flop 1204 when flip-flop 1204 is set. Flip-flop 1204 is reset by the output of OR gate 1203 when terminal EQ of coincidence detector circuit 1201 goes to logic level high or when control signal $S_8$, supplied to terminal 1211, goes to a high logic level. Therefore, time dividing signal $P_C$ goes to a high logic level at time $K_3/256$ milliseconds. Thus, $K_3$ determines how long time dividing signal $P_C$ stays high for a given value of data provided to terminals 1206 to 1210, after control signal $S_9$ sets flip-flop 1204.

Assuming that the temperature characteristic compensation data at terminals 1206 to 1210 is $m_1$, factory peak pace compensation data is $m_2$ and service peak pace compensating data is $m_3$, $m_1$ is utilized in the first two seconds of the 10 second compensation period, $m_2$ is utilized in the next two seconds and $m_3$ is used in the remaining six seconds. During the last four of the remaining six seconds, control signal $S_8$ causes time dividing signal $P_C$ to go to a low logic level. Thus, the time when time dividing signal $P_C$ goes to a high logic level is $K_3(m_1+m_2+m_3)/256$ seconds and the time when time dividing signal $P_C$ goes to a low logic level is $10-(K_3(m_1+m_2+m_3)/256$ seconds. Quartz crystal oscillator circuit 1 oscillates with pace $(y+\Delta y)$ seconds per day when time dividing signal $P_C$ is at a high logic level and oscillates with a pace of y seconds per day when signal $P_C$ is at a low logic level. Therefore, the pace compensated by the time dividing signal $P_C$ is given by the following equation:

$$(((y+\Delta y)(K_3(m_1+m_2+m_3)/256)+y(10-(K_3(m_1+m_2+m_3)/256)))/10)-y=K_3(m_1+m_2+m_3)\Delta y/2{,}560 \text{ sec/day} \quad (8)$$

From equation (8) it follows that a minimum compensation value C is obtained from the following equation:

$$C=K_3 \cdot \Delta y/2560 \text{ sec/day} \quad (9)$$

In this embodiment it is desirable to obtain a minimum compensation value C of 0.2637/32 sec/day. Thus it is preferable that the value $K_3$ obtained by the following equation is written into PROM 1102:

$$K_3 = 0.00824 \cdot 2{,}560/\Delta y \quad (10)$$

Figure 7:
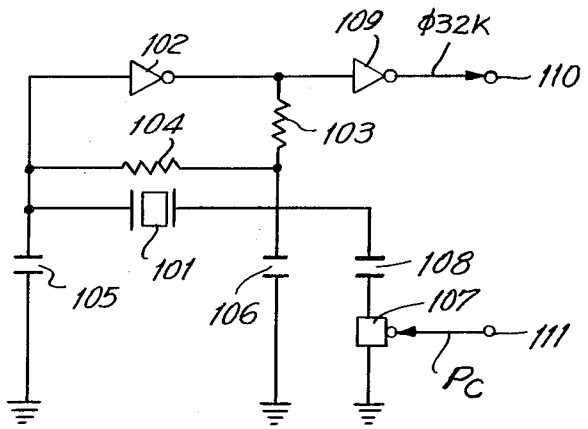
FIG. 7 is a schematic diagram of the crystal oscillator circuit of FIG. 1.

FIG. 7 is a schematic diagram of quartz crystal oscillator circuit 1 of FIG. 1. A tuning fork type crystal vibrator 101, cut at an angle of $+5°$ with respect to the X crystal axis, is connected in series with a ballast resistor 103 between the input and the output of an oscillator inverter 102. A negative feedback resistor 104 is connected directly across crystal vibrator 101. A gate capacitor 106 is connected between one end of crystal vibrator 101 and ground, while a balancing capacitor 105 is connected between the other end of crystal vibrator 101 and ground. A switching capacitor 108 is selectively coupled in parallel with gate capacitor 106 between crystal vibrator 101 and ground by switch 107 which has a first terminal connected to ground and a second terminal connected to one end of switching capacitor 108. Switch 107 is activated by signal $P_C$ applied through terminal 111 to the control terminal of switch 107. Inverter 109 coupled to the output of oscillator inverter 102, performs waveform shaping on said output to produce the $\phi 32K$ signal at terminal 110.

When time dividing signal $P_C$, provided to terminal 111, is at a low logic level, oscillator circuit 1 oscillates at the low frequency of y sec/day. When time dividing signal $P_C$ is at a logic high level, oscillation occurs at the higher pace of $(y+y)$ sec/day. The capacitance of switching capacitor 108 is determined so that the value of $\Delta y$ is larger than $0.2637 \cdot 10/2 = 1.3185$ sec/day, since compensation for the pace of oscillator circuit 1 is performed for only 2 seconds of the 10 second compensation period.

Figure 8:
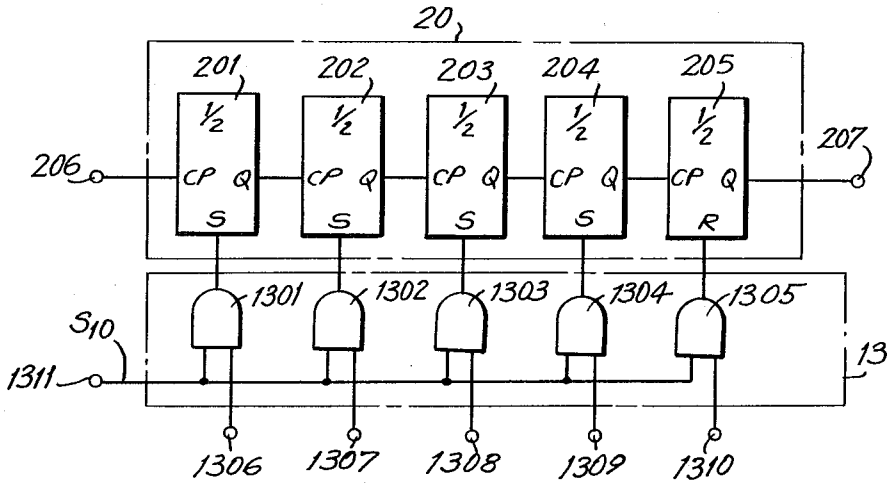
FIG. 8 is a schematic diagram of the logic tuning circuit and divider circuit of FIG. 1.

Logic tuning circuit 13 of FIG. 1, illustrated in FIG. 8, comprises AND gates 1301 to 1305. FIG. 8 also illustrates 1/32 divider circuit 20 of divider circuit 2 which comprises ½ divider circuits 201 to 204 each having a set terminal, and ½ divider circuit 205 having a reset terminal. When control signal $S_{10}$, provided to terminal 1311, goes to a high logic level, 1/32 divider circuit 20 is set to a state of advance or delay determined by input data from terminals 1306 to 1310 of logic tuning circuit 13. The five most significant data bits of the data output of data selecting circuit 10 are provided to terminals 1306 to 1310. Compensation in accordance with each set of data is performed once every ten seconds. Therefore, if it is assumed that the temperature characteristic compensating data provided to terminals 1306 to 1309 is $k_1$, the factory peak pace compensating data provided to terminals 1306 to 1309 is $k_2$, the service peak pace compensating data provided to terminals 1306 to 1309 is $k_3$, factory peak pace compensating data supplied to terminal 1310 is l2 and service peak pace compensating data supplied to terminal 1310 is l3, the amount of compensation provided by logic tuning is given by the following expression:

$$0.2637\cdot((k_1+k_2+k_3)-32\cdot(l_2+l_3))\ \text{(sec/day)} \tag{11}$$

Reference to equations (8) to (10) and expresssion (11) indicates that the pace compensating value according to the compensating method of the illustrated embodiment of the invention is given by the following expression:

$$0.2637/32\cdot((m_1+m_2+m_3)+32\cdot(k_1+k_2+k_3)-1024\cdot l_2+l_3))\ \text{(sec/day)} \tag{12}$$

In the compensating method according to the invention, in order to obtain the values of a', $N_T$ and b in equation (3), which are necessary for adjusting the temperature characteristic and the peak pace, paces $y_1$, $y_2$ and $y_3$ at proper temperatures $\theta_1$, $\theta_2$ and $\theta_3$, and the values of temperatures $N_1$, $N_2$ and $N_3$ are measured and the following simultaneous equations are solved:

$$y_1=-a'\cdot(N_1-N_T)^2+b$$

$$y_2=-a'\cdot(N_2-N_T)^2+b$$

$$y_3=-a'\cdot(N_3-N_T)+b$$

In this calculation, it is unnecessary to have data for the actual temperature $\theta$ and it is further unnecessary to adjust the environment precisely to a given temperature. Further since the difference in the pace $\Delta$ y required for adjusting the minimum compensation value is almost the same over the entire operating temperature range, measurement at any temperature $\theta_1$, $\theta_2$ and $\theta_3$ can be performed. Based on the values of a', $N_t$, b and $\Delta$ y which are obtained by the above measurement, the following calculations are performed:

$$K_1=[2^{10}-N_T]$$

$$K_2=[128(a_o'/a')^{\frac{1}{2}}]$$

$$K_3=[0.00824\cdot 2{,}560/\Delta y]$$

$$K_4=[-b/c]$$

The values which are thus obtained are respectively written into PROM 701, PROM 720, PROM 1102 and factory peak pace compensation circuit 9. This completes adjustment for temperature versus frequency characteristic, minimum compensation value and peak pace. These measurements and adjustments are performed electrically and are easily automated so that the cost of adjustment is small.

In an electronic timepiece having a temperature compensation apparatus according to the present invention, in which pace y is a function of temperature value N as determined by equation (3), $N'=|N-N_T|$ is determined by offset adjusting circuit 70, and $n=[128\cdot N'/K_2]$ is determined by slope adjusting circuit 71. Thus, the value of temperature characteristic compensating data $D_n=[a_o'\cdot n^2/c]$ which is written into address n of Mask ROM 801 becomes equal to the number of compensation steps Y as set forth in equation (4) and a flat temperature characteristic is then achieved.

Further, according to the present invention minimum compensation circuit 11 sets the minimum compensation value C to the value $\frac{1}{2}^5$ of 0.2637 sec/day which is equal to 0.00824 sec/day; the minimum compensation amount achieved by logic tuning. Thus the peak pace is sufficiently compensated to achieve the required accuracy of five seconds per year. Further, the amount of temperature characteristic compensation is far smaller than that which would be required if only logic tuning were used. In addition, in accordance with the present invention when a peak pace adjustment is necessary because of aging or mechanical mishandling of the timepiece, an after service adjustment is precisely and quickly made by cutting the wiring pattern associated with service peak pace compensation circuit 91 is the same manner as is typical for logic tuning. This may be done even by a general watchmaker.

In the embodiment of the invention disclosed herein, compensation for each of the stored compensation data is independently performed at different times during the compensation interval. It will be understood by one skilled in the art that it is also possible to have all of the data appropriately added in a suitable arithmetic unit so that all of the data is used to perform compensation continuously or simultaneously.

Figure 9:
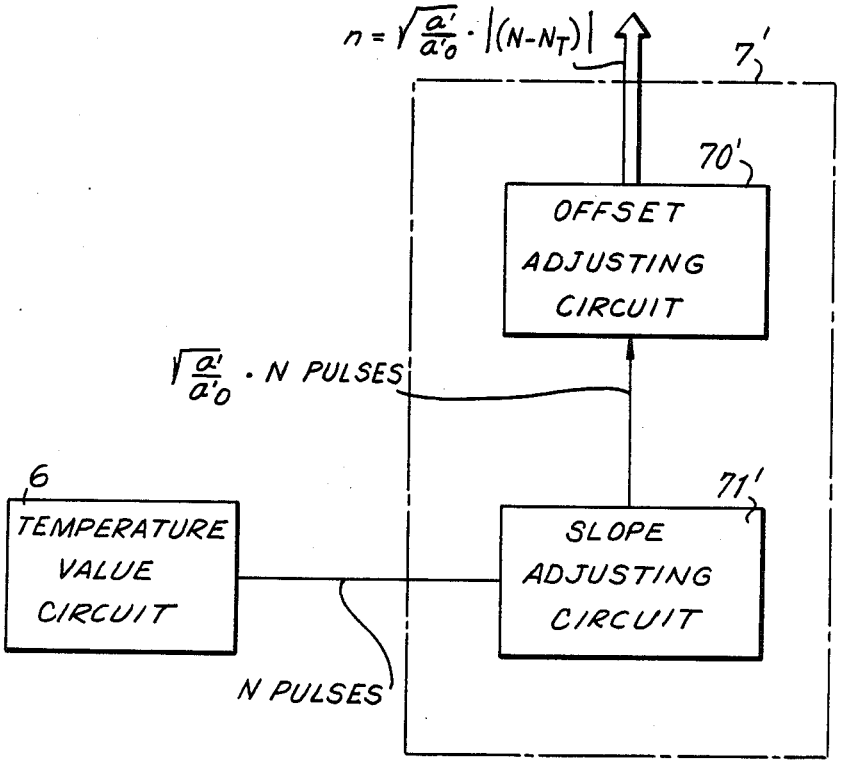
FIG. 9 is a block diagram of an alternative construction of the temperature converting circuit in accordance with the invention.

Referring to FIG. 9, an alternate embodiment of temperature converting circuit 7 is depicted wherein the slope adjustment is accomplished prior to the offset adjustment. Specifically, temperature value circuit 6 appplies N pulses to slope adjusting circuit 71', forming a part of temperature converting circuit 7'. The output of slope adjusting circuit 71' is applied to offset adjusting circuit 70', the output of which is applied to temperature compensation data circuit 8 (FIG. 1).

Figure 10:
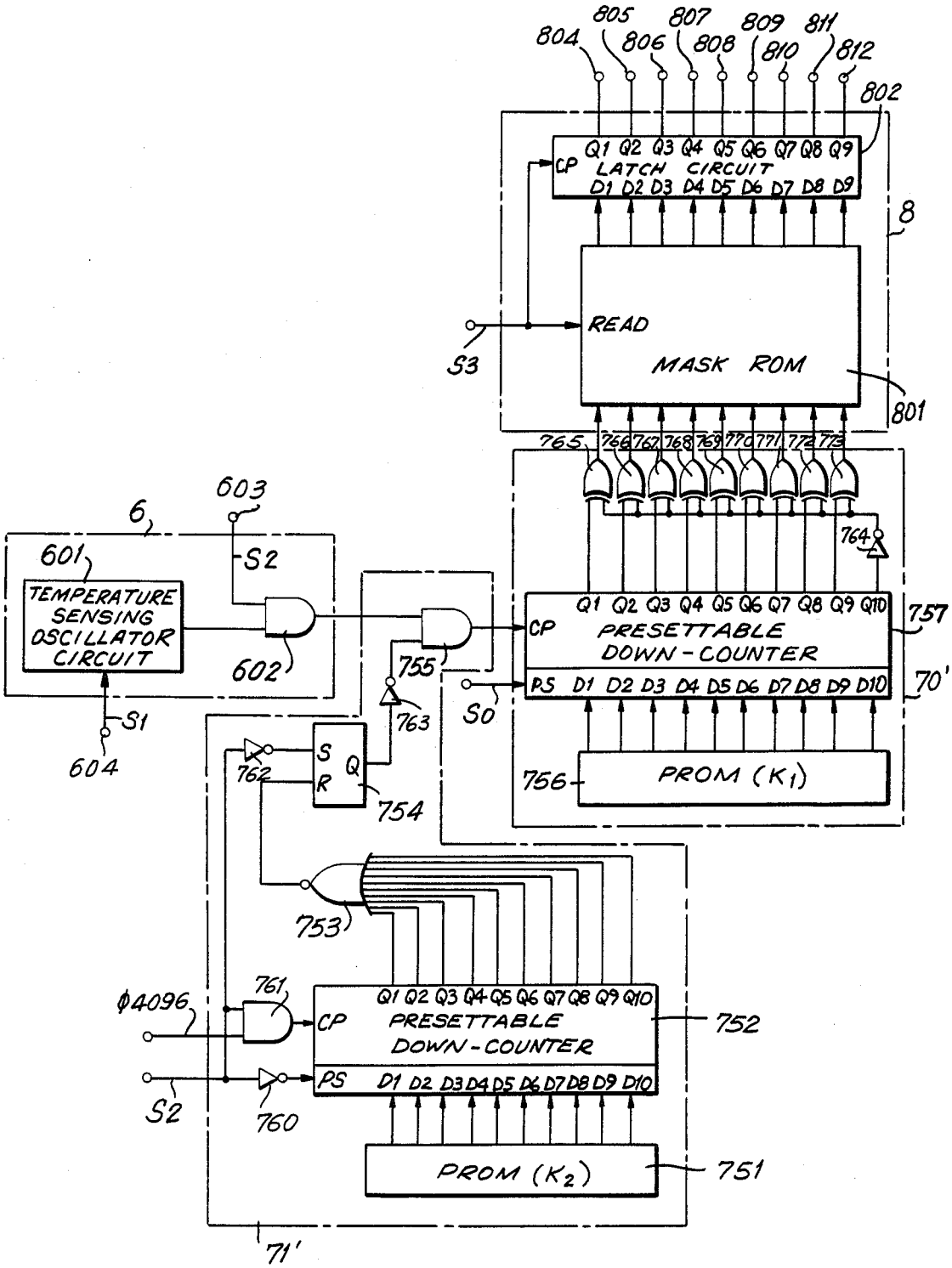
FIG. 10 is a block diagram of the offset and slope adjusting circuits of FIG. 9.

Referring to FIG. 10, the details of structure of one embodiment of slope adjusting circuit 71' and offset adjusting circuit 70' are depicted, like reference numerals being applied to like elements in the first embodiment. Slope adjusting circuit 71' includes a PROM 751 coupled to a presettable down-counter 752. The set signal $S_2$ transferring the contents of PROM 751 to presettable down-counter 752 is applied to inverter 760. The clock signal $\phi$4096 is applied through AND gate 761 to presettable down-counter 752. The output of presettable down-counter 752 is applied to NOR gate 716, the output of which is applied to the reset terminal of R-S flip-flop 754, the $S_2$ signal being applied through inverter 762 to the set terminal of said flip-flop circuit. The Q output R-S flip-flop circuit 754 is applied through inverter 763 to AND gate 755, the other input to AND gate 755 being the output of AND gate 602 of temperature value circuit 6.

In operation, the 10 bits of $K_2$ stored in PROM 751 are written into presettable down-counter 752 when signal $S_2$ is at a low level. $K_2$ has the following value:

$$K_2 = \left[1024\left(1 - \sqrt{\frac{a'}{a'_0}}\right)\right].$$

When signal $S_2$ is high the value $K_2$ is counted down by signal $\phi$4096, having a frequency of 4,096 Hz.

When signal $S_2$ is at a low level, the output of R-S flip-flop 754 is always at a high level. When signal $S_2$ is at a high level, NOR gate 753 detects the value of the output of presettable down-counter 752 to reset the output of R-S flip-flop 754 at a low level after presettable down-counter 752 has been counted to zero from the value $K_2$.

AND gate 755 transfers the pulse supplied by AND gate 602 only if the output of R-S flip-flop 754 is at a low level. Thus, the pulse number passing through AND gate 755 is represented by the equation:

$$\frac{(1024 - K_2)}{1024} \cdot N = \sqrt{\frac{a'}{a'_0}} \cdot N \text{ pulses}$$

Offset adjustment circuit 70' includes a PROM 756 in which is stored $K_1$ represented by 10 bits. PROM 756 is coupled to presettable down-counter 757. Signal $S_0$ is applied to the present terminal of presettable down-counter 757 to write $K_1$ into said down-counter while the output from AND gate 755 is applied as a clock to the CP terminal of said down-counter. $K_1$ is represented as follows:

$$K_1 = \left[\frac{1024 - K_2}{1024} \cdot N_T\right]$$

The value $K_1$ is set in presettable down-counter 757 by signal $S_0$ and counted down by pulses passing through AND gate 755 from AND gate 602 of temperature compensation data circuit 8. The Q1–Q9 outputs of resettable down-counter 757 are applied to exclusive OR circuits 765–773, respectively. Output Q10 of presettable down-counter 757 is applied through inverter 764 as the second input to said exclusive OR gates.

After counting, the output of AND gate 755 is represented by the equation:

$$K_1 - \frac{(1024 - K_2)}{1024} \cdot N =$$

$$\frac{(1024 - K_2)}{1024}(N_T - N) = \sqrt{\frac{a'}{a'_0}}\,(N_T - N)$$

The value passed by exclusive OR gates 764–773 is represented by the equation:

$$n = \sqrt{\frac{a'}{a'_0}}\,|N - N_T|$$

Date written in Mask ROM 801 of temperature compensation data circuit 8 is read as addressed by the output of exclusive OR gates 765–773 in response to the signal $S_3$.

Thus, in an electronic timepiece according to the invention variations in the offset value of temperature and in the peak temperature of the quartz crystal vibrator can be adjusted by an offset adjusting means. Variations in the slope of the temperature value in the second order temperature coefficient of the quartz crystal vibrator can also be adjusted by a slope adjusting means. Therefore, the present invention enables a large integrated Mask ROM to produce temperature characteristic compensating data suitable for the pace and temperature characteristics of each timepiece, without using a special quartz crystal vibrator divided into segments in accordance with the peak temperature and the second order temperature coefficient. As a result, a timepiece of low price, small size and high precision may be produced.

Further, in an electronic timepiece of high precision in accordance with the present invention, a first compensation means controls the oscillator in accordance with M least significant bits of data and a second compensation means compensates pace by controlling the divider circuit in accordance with the remaining, most significant bits of the data. In addition, a minimum compensation value of the first compensation means is set to $\frac{1}{2}^M$ of the minimum compensation value of the second compensation means. Therefore, when the value of the second compensation data represented as D-bit data is d, the value represented by the M least significant bits of the D-bit data is m, the value represented by the remaining K-bits is k and the minimum compensation value of the second compensation means is g sec/day, the compensating value is represented by $((g/2^M)\cdot m + g\cdot k) = g\cdot(m + 2^M k)/2^M = g\cdot d/2^M$ sec/day, so that digital tuning having a resolution of $g/2^M$ sec/day and an adjusting width of $(g\cdot 2^D/2^M) = (g\cdot 2^K)$ sec/day is achieved.

As shown with respect to the present embodiment, in a case where the first and second compensation means are controlled by 5-bit data and the minimum compensation width of the second compensation means is 0.2637 sec/day, a digital tuning method having a resolution of $0.2637/2^5 = 0.00824$ sec/day provides compensation equivalent to that achieved by a trimmer capacitor and a much larger adjusting width of $0.2637 \times 2^5 = 8.4384$ sec/day.

Therefore in the present invention the pace adjustment is realized with accuracy, precision and speed. Further, since a trimmer capacitor is not used, there is no change in the pace due to mechanical vibration caused by, for example, dropping the timepiece or a change in humidity. Finally, a small sized timepiece can be produced.

It will thus be seen that the objects set forth above, among those made apparent from the preceding description, are efficiently attained and, since certain changes may be made in carrying out the above method and in the construction set forth without departing from the spirit and scope of the invention, it is intended that all matter contained in the above description and shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. An electronic timekeeping apparatus, comprising:

a temperature value generating means for generating a temperature value;

a temperature value converting means which provides a slope corrected output in accordance with a frequency versus temperature characteristic of said apparatus in response to said temperature value;

an offset adjusting means which operates on said temperature value so that said slope corrected output is referenced with respect to a predetermined temperature, at least one of said slope adjusting means and said offset adjusting means comprising a PROM;

a pace compensation data means for producing pace compensation data corresponding to said slope corrected output, said pace compensation data means including a Mask ROM in which the pace compensating data is stored; and a pace compensating means for compensating the pace of said apparatus in accordance with said pace compensation data.

2. The apparatus of claim 1, wherein said Mask ROM provides said pace compensation data when addressed by said slope corrected output.

3. The apparatus of claim 1, wherein said offset adjusting means comprises an absolute value generating means for generating an output representing said absolute value of said difference between said temperature value and a predetermined value.

4. The apparatus of claim 3, wherein said predetermined value is a temperature value corresponding to the peak temperature of the temperature compensation characteristic of said apparatus.

5. The apparatus of claim 1, wherein said offset adjusting means comprises:

storage means for storing an offset adjusting value;

a presettable up-counter, said up-counter being preset with said offset adjusting value, said up-counter counting a number of pulses supplied from said temperature value generating means, said number of said pulses representing temperature;

an inverter connected to an output of said up-counter corresponding to a most significant bit thereof; and a plurality of exclusive NOR gates, each exclusive NOR gate having a first input connected to an output of said up-counter other than that corresponding to said most significant bit, and a second input connected to an output of said inverter.

6. The apparatus of claim 1, wherein said electronic timekeeping apparatus further comprises:

an oscillator, and a divider circuit for frequency dividing an output of said oscillator, said oscillator and said divider circuit defining said pace of said apparatus; and wherein said pace compensating means comprises:

a first compensation means responsive to M least significant data bits of said pace compensation data for compensating pace by controlling said oscillator; and a second compensation means responsive to data bits of said pace compensation data other than said least significant bits, for compensating pace by controlling said divider circuit.

7. The apparatus of claim 6, wherein said second compensation means comprises a logic tuning circuit, said logic tuning circuit providing outputs to said divider circuit for advancing or delaying operation of said divider circuit.

8. The apparatus of claim 6, wherein said first compensation means includes means for defining a minimum compensation amount, and means permitting operation of said first compensation means for periods of time each equal to a multiple of the minimum compensation amount as determined from said pace compensation data.

9. The apparatus of claim 8, further comprising means permitting operation of said first compensation means only during predetermined portions of successive time periods.

10. The apparatus of claim 9, wherein said first compensation means comprises:

storage means for storing a minimum compensation value;

counter means for counting pulses of a substantially fixed frequency supplied to said counter means;

coincidence means for providing an output signal when said counter contains a count equal to said minimum compensation value; and reset means for resetting said counter in response to one of said output signal and a reset signal, said reset signal being supplied to said time dividing circuit to begin one of said predetermined portions of time.

11. The apparatus of claim 10, wherein said first compensation circuit further comprises:

a counter for receiving said output signals from said coincidence means which cause said counter to produce a count;

a comparator means for producing a coincidence output signal when said count is equal to at least a portion of said pace compensation data; and an oscillator control means for providing an output to cause said oscillator to change pace, said oscillator control means being set from a first condition to a second condition by a reset signal, said reset signal serving to reset said counter, and said oscillator control means being reset by one of said coincidence output signal and a control signal fixed in time with respect to said reset signal.

12. The apparatus of claim 8, further comprising:

a factory peak pace compensation means for storing a factory peak pace compensation value;

a service peak pace compensation means for storing an after service peak pace compensation value; and a data selecting means for selecing data from one of said pace compensation data means, said factory peak pace compensation means and said service peak pace compensation means during predetermined time periods, data selected by said data selecting means being supplied to said means for permitting operation of said first compensation means as the data multiplying said minimum compensation amount.

13. The apparatus of claim 1, further comprising:

a factory peak pace compensation means for storing a factory peak pace compensation value;

a service peak pace compensation means for storing an after service peak pace compensation value; and a data selecting means for selecting data from one of said pace compensation data means, said factory peak pace compensation means and said service peak pace compensation means during predetermined time periods, data selected by said data selecting means being supplied to said pace compensating means to compensate said pace.

14. The apparatus of claim 1, wherein said temperature value generating means comprises:

a temperature sensing oscillator circuit having an output frequency which varies with temperature; and gate means for providing an output having a number of pulses, said number being equal to a number of pulses of said oscillator circuit which occur during a substantially fixed time interval.

15. The apparatus of claim 1, wherein said slope adjusting means comprises:

multiplying means for multiplying the temperature value after offset adjustment by a constant to provide a multiplied output; and dividing means for dividing said multiplied output by a slope adjusting value to provide said slope corrected output.

16. The apparatus of claim 15, wherein said multiplying means comprises:

a presettable down-counter means preset with said temperature value after offset adjustment upon receiving a preset signal;

a first frequency source of a first frequency for clocking said down-counter means;

zero sensing means connected to outputs of said down-counter means for providing a zero indicating signal when said down-counter means has counted to zero;

a second frequency source having a frequency equal to a said first frequency of said first frequency source times said constant; and gate means responsive to a preset signal supplied to said down-counter and to said zero indicating signal for passing pulses of said second frequency source from a time at which said preset signal occurs until said zero indicating signal occurs.

17. The apparatus of claim 16, wherein said dividing means comprises:

PROM means for storing said slope adjusting value;

a first counter for receiving input pulses for a duration corresponding to the temperature value after offset adjustment;

coincidence means for providing a coincidence output signal when a count in said counter is equal to said slope adjusting value;

reset means for resetting said counter in response to said coincidence output signal; and a second counter for counting said number of times of occurrence of said coincidence output signal.

18. The apparatus of claim 17, wherein said Mask ROM is addressed by a count of said second counter, so that said Mask ROM reads out said pace compensation data.

19. An electronic timekeeping apparatus comprising:

an oscillator and a multistage divider circuit for frequency dividing an output of said oscillator, said oscillator and said divider circuit defining a pace of said apparatus;

a pace compensation data means for providing pace compensation data for compensating the pace of said apparatus;

a first compensation means responsive to M least significant data bits of said pace compensation data for compensating pace by controlling said oscillator;

a second compensation means responsive to a plurality of the most significant bits of said pace compensation data for compensating pace by controlling said divider circuit, said second compensation means comprising logic tuning means for coupling individual bits of said most significant bits of pace compensating data to appropriate stages of said multistage divider circuit to advance or delay operation of said divider circuit.

20. The apparatus of claim 19, further comprising:

means for setting a first minimum compensation value for said first compensation means to $\frac{1}{2}^{M}$ of a second minimum compensation amount of said second compensation means.

21. The apparatus of claim 19, wherein said first compensation means includes means for defining a minimum compensation amount, and means permitting operation of said first compensation means for periods of time each equal to a multiple of the minimum compensation amount as determined from said pace compensation data.

22. The apparatus of claim 19, further comprising means permitting operation of said first compensation means only during predetermined portions of successive time periods.

23. The apparatus of claim 22, wherein said first compensation means comprises:

storage means for storing a minimum compensation value;

counter means for counting pulses of a substantially fixed frequency supplied to said counter means;

coincidence means for providing an output signal when said counter contains a count equal to said minimum compensation value; and reset means for resetting said counter in response to one of said output signal and a reset signal, said reset signal being supplied to said time dividing circuit to begin one of said predetermined portions of time.

24. The apparatus of claim 23, wherein said first compensation circuit further comprises:

a counter for receiving said output signals from said coincidence means for causing said counter to produce a count;

a comparator means for producing a coincidence output signal when said count is equal to at least a portion of said pace compensation data; and an oscillator control means for providing an output to cause said oscillator to change pace, said oscillator control means being set from a first condition to a second condition by a reset signal, said reset signal serving to reset said counter, and said oscillator control means being reset by one of said coincidence output signal and a control signal fixed in time with respect to said reset signal.

25. The apparatus of claim 19, further comprising:

a factory peak pace compensation circuit for storing a factory peak pace compenstion value;

a service peak pace compensation circuit for storing an after service peak pace compensation value; and a data selecting means for selecting data from one of said pace compensation data means, said factory peak pace compensation circuit and said service peak pace compensation circuit during predetermined time periods, data selected by said data selecting means being supplied to said means for permitting operation of said first compensation means as the data multiplying said minimum compensation amount.

26. The apparatus of claim 19, wherein said pace compensation data means produces pace compensation data for compensating pace in response to variations in temperature of said apparatus.

27. An electronic timekeeping apparatus comprising:

a temperature value generating means for generating a temperature value;

a temperature value converting means including an offset adjusting means for operating on said temperature value to produce a temperature referenced value referenced with respect to a predetermined temperature, and a slope adjusting means for producing a slope corrected output in accordance with a frequency versus temperature characteristic of said apparatus in response to said temperature referenced value;

a pace compensation data means including a mask ROM, said mask ROM producing pace compensation data corresponding to said slope corrected output;

a pace compensating means for compensating the pace of said apparatus in accordance with said pace compensation data.

28. A method for compensating the pace of an electronic timekeeping apparatus comprising the steps of:

generating a temperature value corresponding to the temperature of said apparatus;

correcting said temperature value in accordance with at least one of the slope and the offset of the peak value of the frequency versus temperature characteristic of said apparatus to produce a corrected temperature value;

producing pace compensation data in response to said corrected temperature value;

providing a factory peak pace compensation value; and during a predetermined compensation period, correcting the pace of said apparatus for said corrected temperature value, and said factory peak pace compensation value.

29. The method of claim 28, wherein said correcting of the pace of said apparatus for said corrected temperature value and for said factory peak pace compensation value are each performed at different times during said compensation period.

30. The method of claim 28, and comprising the further step of:

providing a service peak compensation value for use later in the life of said timekeeping apparatus; and later in the life of said apparatus, correcting the pace of the apparatus by said service peak pace compensation value during said predetermined period.

31. The method of claim 30, wherein the correcting of the pace of said apparatus for said corrected temperature value, for said factory peak pace compensation value and for said service peak compensation value are each performed at different times during said compensation period.

32. An electronic timekeeping apparatus comprising:

a temperature value means for generating a temperature value related to the temperature of the apparatus;

an offset adjusting means having the temperature value as an input, the offset adjusting means including an offset adjusting value determining means which provides an adjusted temperature value as an output;

a slope correcting means having the offset adjusted temperature value as an input, the slope correcting means comprising a slope adjusting value determining means which has a converted temperature value as an output; and a temperature compensating data means responsive to the converted temperature value for providing pace adjusting data for compensating of the pace of the apparatus;

at least one of the offset adjusting value determining means and the slope adjusting value determining means comprising a programable read-only memory (PROM).

33. The apparatus of claim 32, in which the temperature compensating data means comprises a Mask read only memory (Mask ROM) which is addressed by the converted temperature value to provide the pace adjusting data.

34. Apparatus for providing a temperature compensating value for adjusting the pace of an electronic timepiece, the apparatus comprising:

a temperature value means for generating a temperature value related to the temperature of the apparatus;

an offset adjusting means having the temperature value as an input, the offset adjusting means including an offset adjusting value determining means which provides an offset adjusted temperature value as an output;

a slope correcting means having the offset adjusted temperature value as an input, the slope correcting means including a slope adjusting value determining means for correcting the slope of the offset adjusted temperature value to provide a converted temperature value as an output; and temperature compensating data means responsive to the converted temperature value to provide pace adjusting data for adjustment of the pace of the apparatus, the temperature compensating data means comprising a Mask read only memory (Mask ROM) which is addressed by the converted temperature value.

35. The apparatus of claim 34, in which at least one of the offset adjusting value determining means and the slope adjusting value determining means comprises a programmable read only memory (PROM).

36. An electronic timekeeping apparatus comprising:

an oscillator, and a frequency divider circuit for dividing the frequency of the output of the oscillator, the oscillator and the divider circuit establishing a pace of the apparatus;

a temperature value generating means for generating a temperature value;

a temperature value converting means including a slope adjusting means which provides a slope corrected output in accordance with a frequency versus temperature characteristic of the apparatus in response to the temperature value;

a pace compensation data means for producing pace compensation data corresponding to the slope corrected output;

a pace compensating means for compensating said pace of said apparatus in accordance with said pace compensation data;

a first compensation means responsive to M least significant data bits of the pace compensation data for compensating said pace by controlling the frequency of the oscillator, the first compensation means including means for defining a minimum compensation amount and means which permit operation of the first compensation means for periods of time each of which is equal to a multiple of the minimum compensation amount as determined from said pace compensation data;

a second compensation means responsive to data bits of said pace compensation data other than the least significant bits for compensating said pace by controlling the divider circuit;

a factory peak pace compensation circuit for storing a factory peak pace compensation value;

a service peak pace compensation circuit for storing an after service peak pace compensation value; and a data selecting means for selecting data from one of the pace compensation data means, the factory peak pace compensation means, and the service peak compensation means during at least one predetermined time period, the data selected by the data selecting means being supplied to the means for permitting operation of the first compensation means as the data multiplying the minimum compensation amount.

37. An electronic timekeeping apparatus, comprising:

a temperature value generating means for generating a temperature value;

a temperature value converting means including a slope adjusting means which provides a slope corrected output in accordance with a frequency versus temperature characteristic of the apparatus in response to the temperature value;

a pace compensation data means for producing pace compensation data corresponding to the slope corrected output;

a pace compensating means for compensating the pace of said apparatus in accordance with the pace compensation data;

a factory peak pace compensation circuit for storing a factory peak pace compensation value;

a service peak pace compensation circuit for storing an after service peak pace compensation value; and a data selecting means for selecting data from one of said pace compensation data means, said factory peak pace compensation circuit and said service peak pace compensation circuit during predetermined time periods, data selected by said data selecting means being supplied to said pace compensating means to compensate said pace.

38. An electronic timekeeping apparatus comprising:

an oscillator and a divider circuit for frequency dividing an output of said oscillator, said oscillator and said divider circuit being for defining a pace of said apparatus;

a pace compensation data means for producing pace compensation data for compensating said pace of said apparatus;

a first compensation means responsive to M least significant data bits of said pace compensation data for compensating said pace by controlling said oscillator;

a second compensation means responsive to data bits of said pace compensation data other than said least significant bits, for compensating said pace by controlling said divider circuit;

a factory peak pace compensation circuit for storing a factory peak pace compensation value;

a service peak pace compensation circuit for storing an after service peak pace compensation value; and a data selecting means for selecting data from one of said pace compensation data means, said factory peak pace compensation circuit and said service peak pace compensation circuit during predetermined time periods, data selected by said data selecting means being supplied to said means for permitting operation of said first compensation means as the data multiplying said minimum compensation amount.

39. An electronic timekeeping apparatus, comprising:

a temperature value generating means for generating a temperature value;

a temperature value converting means which provides a slope corrected output in accordance with a frequency versus temperature characteristic of said apparatus in response to said temperature value;

an offset adjusting means which operates on said slope corrected output to produce an offset adjusted slope corrected output referenced with respect to a predetermined temperature, at least one of said slope adjusting means and said offset adjusting means comprising a PROM;

a pace compensation data means for producing pace compensation data corresponding to said offset adjusted slope corrected output, said pace compensation data means including a Mask ROM in which the pace compensating data is stored; and a pace compensating means for compensating the pace of said apparatus in accordance with said pace compensation data.

40. The apparatus of claim 39, wherein said Mask ROM provides said pace compensation data when addressed by said offset adjusted slope corrected output.

41. The apparatus of claim 39, wherein said offset adjusting means comprises an absolute value generating means for generating an output representing said absolute value of said difference between said temperature value and a predetermined value.

42. The apparatus of claim 41, wherein said predetermined value is a temperature value corresponding to the peak temperature of the temperature compensation characteristic of said apparatus.

43. The apparatus of claim 39, wherein said offset adjusting means comprises:

storage means for storing an offset adjusting value;

a presettable down-counter, said down-counter being preset with said offset adjusting value, said down-counter counting a number of pulses supplied from said temperature value converting means, said number of said pulses representing slope corrected temperature;

an inverter connected to an output of said down-counter corresponding to a most significant bit thereof; and a plurality of exclusive NOR gates, each exclusive NOR gate having a first input connected to an output of said down-counter other than that corresponding to said most significant bit, and a second input connected to an output of said inverter.

44. The apparatus of claim 39, wherein said electronic timekeeping apparatus further comprises:

an oscillator, and a divider circuit for frequency dividing an output of said oscillator, said oscillator and said divider circuit defining said pace of said apparatus; and wherein said pace compensating means comprises:

a first compensation means responsive to M least significatnt data bits of said pace compensation data for compensating pace by controlling said oscillator; and a second compensation means responsive to data bits of said pace compensation data other than said least significant bits, for compensating pace by controlling said divider circuit.

45. The apparatus of claim 44, wherein said second compensation means comprises a logic tuning circuit, said logic tuning circuit providing outputs to said divider circuit for advancing or delaying operation of said divider circuit.

46. The apparatus of claim 44, wherein said first compensation means includes means for defining a minimum compensation amount, and means permitting operation of said first compensation means for periods of time each equal to a multiple of the minimum compensation amount as determined from said pace compensation data.

47. The apparatus of claim 46, further comprising means permitting operation of said first compensation means only during predetermined portions of successive time periods.

48. The apparatus of claim 47, wherein said first compensation means comprises:

storage means for storing a minimum compensation value;

counter means for counting pulses of a substantially fixed frequency supplied to said counter means;

coincidence means for providing an output signal when said counter contains a count equal to said minimum compensation value; and reset means for resetting said counter in response to one of said output signal and a reset signal, said reset signal being supplied to said time dividing circuit to begin one of said predetermined portions of time.

49. The apparatus of claim 48, wherein said first compensation circuit further comprises:

a counter for receiving said output signals from said coincidence means which cause said counter to produce a count;

a comparator means for producing a coincidence output signal when said count is equal to at least a portion of said pace compensation data; and an oscillator control means for providing an output to cause said oscillator to change pace, said oscillator control means being set from a first condition to a second condition by a reset signal, said reset signal serving to reset said counter, and said oscillator control means being reset by one of said coincidence output signal and a control signal fixed in time with respect to said reset signal.

50. The apparatus of claim 46, further comprising:

a factory peak pace compensation means for storing a factory peak pace compensation value;

a service peak pace compensation means for storing an after service peak pace compensation value; and a data selecting means for selecting data from one of said pace compensation data means, said factory peak pace compensation means and said service peak pace compensation means during predetermined time periods, data selected by said data selecting means being supplied to said means for permitting operation of said first compensation means as the data multiplying said minimum compensation amount.

51. The apparatus of claim 39, further comprising:

a factory peak pace compensation means for storing a factory peak pace compensation value;

a service peak pace compensation means for storing an after service peak pace compensation value; and a data selecting means for selecting data from one of said pace compensation data means, said factory peak pace compensation means and said service peak pace compensation means during predetermined time periods, data selected by said data selecting means being supplied to said pace compensating means to compensate said pace.

52. The apparatus of claim 39, wherein said temperature value generating means comprises:

a temperature sensing oscillator circuit having an output frequency which varies with temperature; and gate means for providing an output having a number of pulses, said number being equal to a number of pulses of said oscillator circuit which occur during a substantially fixed time interval.

53. The apparatus of claim 39, wherein said slope adjusting means comprises:

a storage means for storing a slope adjusting value;

a presettable down-counter means preset with said slope adjusting value upon receiving a preset signal;

a first frequency source of a first frequency for clocking said down-counter means;

zero sensing means connected to outputs of said down-counter means for providing a zero indicating signal when said down-counter means has counted to zero; and gate means responsive to a preset signal supplied to said down-counter and to said zero indicating signal for passing pulses of said temperature value generating means from a time at which said preset signal occurs until said zero indicating signal occurs.

54. The apparatus of claim 53, wherein said storage means is a PROM.

55. The apparatus of claim 43, wherein said Mask ROM is addressed by the output of said exclusive NOR gates, so that said Mask ROM reads out said pace compensation data.

56. An electronic timekeeping apparatus comprising:

an oscillator and a multistage divider circuit for frequency dividing an output of said oscillator, said oscillator and said divider circuit defining a pace of said apparatus;

a pace compensation data means for providing pace compensation datae for compensating the pace of said apparatus;

a first compensation means responsive to M least significant data bits of said pace compensation data for compensating pace by controlling said oscillator;

a second compensation means responsive to a plurality of the most significant bits of said pace compensation data for compensating pace by controlling said divider circuit; and means for setting a first minimum compensation value for said first compensation means to $\frac{1}{2}^{M}$ of a second minimum compensation amount of said second compensation means.

57. The apparatus of claim 56, said second compensation means comprising logic tuning means for coupling individual bits of said most significant bits of pace compensating data to appropriate stages of said multistage divider circuit to advance or delay operation of said divider circuit.

58. The apparatus of claim 56, wherein said first compensation means includes means for defining a minimum compensation amount, and means permitting operation of said first compensation means for periods of time each equal to a multiple of the minimum compensation amount as determined from said pace compensation data.

59. The apparatus of claim 56, further comprising means permitting operation of said first compensation means only during predetermined portions of successive time periods.

60. The apparatus of claim 59, wherein said first compensation means comprises:

storage means for storing a minimum compensation value;

counter means for counting pulses of a substantially fixed frequency supplied to said counter means;

coincidence means for providing an output signal when said counter contains a count equal to said minimum compensation value; and reset means for resetting said counter in response to one of said output signal and a reset signal, said reset signal being supplied to said time dividing circuit to begin one of said predetermined portions of time.

61. The apparatus of claim 60, wherein said first compensation circuit further comprises:

a counter for receiving said output signals from said coincidence means for causing said counter to produce a count;

a comparator means for producing a coincidence output signal when said count is equal to at least a portion of said pace compensation data; and an oscillator control means for providing an output to cause said oscillator to change pace, said oscillator control means being set from a first condition to a second condition by a reset signal, said reset signal serving to reset said counter, and said oscillator control means being reset by one of said coincidence output signal and a control signal fixed in time with respect to said reset signal.

62. The apparatus of claim 56, further comprising:

a factory peak pace compensation circuit for storing a factory peak pace compensation value;

a service peak pace compensation circuit for storing an after service peak pace compensation value; and a data selecting means for selecting data from one of said pace compensation data means, said factory peak pace compensation circuit and said service peak pace compensation circuit during predetermined time periods, data selected by said data selecting means being supplied to said means for permitting operation of said first compensation means as the data multiplying said minimum compensation amount.

63. The apparatus of claim 56, wherein said pace compensation data means produces pace compensation data for compensating pace in response to variations in temperature of said apparatus.

64. An electronic timekeeping apparatus comprising:

a temperature value generating means for generating a temperature value;

a temperature value converting means including a slope adjusting means for producing a slope corrected output in accordance with a frequency versus temperature characteristic of said apparatus in response to said temperature value, and an offset adjusting means for operating on said slope corrected value to produce an offset adjusted slope corrected output referenced with respect to a predetermined temperature;

a pace compensation data means including a mask ROM, said mask ROM producing pace compensation data corresponding to said offset adjusted slope corrected output;

a pace compensating means for compensating the pace of said apparatus in accordance with said pace compensation data.

65. An electronic timekeeping apparatus comprising:

a temperature value means for generating a temperature value related to the temperature of the apparatus;

a slope correcting means having the temperature value as an input, the slope correcting means comprising a slope adjusting value determining means which has a converted temperature value as an output;

an offset adjusting means having the converted temperature value as an input, the offset adjusting means including an offset adjusting value determining means which provides an offset adjusted converted temperature value as an output; and a temperature compensating data means responsive to the offset adjusted converted temperature value for providing pace adjusting data for compensating of the pace of the apparatus;

at least one of the offset adjusting value determining means and the slope adjusting value determining means comprising a programable read-only memory (PROM).

66. The apparatus of claim 65, in which the temperature compensating data means comprises a Mask read only memory (Mask ROM) which is addressed by the offset adjusted converted temperature value to provide the pace adjusting data.

67. Apparatus for providing a temperature compensating value for adjusting the pace of an electronic timepiece, the apparatus comprising:

a temperature value means for generating a temperature value related to the temperature of the apparatus;

a slope correcting means having the temperature value as an input, the slope correcting means including a slope adjusting value determining means for correcting the slope of the adjusted temperature value to provide a converted temperature value as an output;

an offset adjusting means having the converted temperature value as an input, the offset adjusting means including an offset adjusting value determining means which provides an offset adjusted converted temperature value as an output;

temperature compensating data means responsive to the offset adjusted converted temperature value to provide pace adjusting data for adjustment of the pace of the apparatus, the temperature compensating data means comprising a Mask read only memory (Mask ROM) which is addressed by the offset adjusted converted temperature value.

68. The apparatus of claim 67, in which at least one of the offset adjusting value determining means and the slope adjusting value determining means comprises a programmable read only memory (PROM).

* * * * *